US010755513B2

(12) United States Patent
Yokawa

(10) Patent No.: US 10,755,513 B2
(45) Date of Patent: Aug. 25, 2020

(54) BANKNOTE PROCESSING APPARATUS

(71) Applicant: GLORY LTD., Hyogo (JP)

(72) Inventor: Takeshi Yokawa, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 16/563,970

(22) Filed: Sep. 9, 2019

(65) Prior Publication Data

US 2020/0005577 A1 Jan. 2, 2020

Related U.S. Application Data

(63) Continuation of application No. 15/921,717, filed on Mar. 15, 2018, now Pat. No. 10,442,651.

(30) Foreign Application Priority Data

Mar. 15, 2017 (JP) ..... 2017-049794

(51) Int. Cl.
*B65H 29/00* (2006.01)
*G07D 11/18* (2019.01)
(Continued)

(52) U.S. Cl.
CPC ..... *G07D 11/18* (2019.01); *B65H 29/006* (2013.01); *B65H 31/24* (2013.01); *G07D 11/10* (2019.01);
(Continued)

(58) Field of Classification Search
CPC ..... B65H 29/006; B65H 29/008; B65H 2701/1912; B65H 2301/341;
(Continued)

(56) References Cited

U.S. PATENT DOCUMENTS 6,439,395 B1 8/2002 Voellmer et al.
6,574,569 B1 6/2003 Omata et al.
2012/0273516 A1 11/2012 Cooke et al.

FOREIGN PATENT DOCUMENTS

DE 19810928 A1 9/1999
EP 1393823 A2 3/2004
(Continued)

OTHER PUBLICATIONS

Extended European Search Report for EP18161447.0 dated Jul. 13, 2018.

*Primary Examiner* — Jeremy R Severson
(74) *Attorney, Agent, or Firm* — Brundidge & Stanger, P.C.

(57) ABSTRACT

A banknote processing apparatus capable of properly storing and dispensing a banknote is provided. The banknote processing apparatus includes: a transport unit that transports a banknote; a long-edge orientation storage unit that receives and stores, in a first orientation, the banknote transported by the transport unit, the first orientation being an orientation in which a short edge of the banknote is a leading edge thereof; a short-edge orientation storage unit that receives and stores, in a second orientation, the banknote transported by the transport unit, the second orientation being an orientation in which a long edge of the banknote is a leading edge thereof; and a control unit that selects, by controlling the transport unit, a storage destination for the banknote transported by the transport unit, from among any of the long-edge orientation storage unit and the short-edge orientation storage unit.

16 Claims, 10 Drawing Sheets

(51) Int. Cl.

| | |
|---|---|
| ***G07D 11/13*** | (2019.01) |
| ***G07D 11/14*** | (2019.01) |
| ***G07D 11/20*** | (2019.01) |
| ***G07D 11/22*** | (2019.01) |
| ***G07D 11/50*** | (2019.01) |
| ***G07D 11/125*** | (2019.01) |
| ***B65H 31/24*** | (2006.01) |
| ***G07D 11/16*** | (2019.01) |
| ***G07D 11/10*** | (2019.01) |

(52) U.S. Cl.
CPC ..... *G07D 11/125* (2019.01); *G07D 11/13* (2019.01); *G07D 11/14* (2019.01); *G07D 11/16* (2019.01); *G07D 11/20* (2019.01); *G07D 11/22* (2019.01); *G07D 11/50* (2019.01); *B65H 2301/3121* (2013.01); *B65H 2301/33216* (2013.01); *B65H 2301/33222* (2013.01); *B65H 2301/34112* (2013.01); *B65H 2511/10* (2013.01); *B65H 2511/20* (2013.01); *B65H 2511/416* (2013.01); *B65H 2515/81* (2013.01); *B65H 2515/842* (2013.01); *B65H 2701/1912* (2013.01); *G07D 2207/00* (2013.01); *G07D 2211/00* (2013.01)

(58) Field of Classification Search
CPC .. B65H 2301/3411; B65H 2301/34112; G07D 11/0021
See application file for complete search history.

(56) References Cited

FOREIGN PATENT DOCUMENTS

| | | | | |
|---|---|---|---|---|
| JP | 6042950 | A | 3/1985 | |
| WO | 2013050177 | A1 | 4/2013 | |
| WO | WO-2013050177 | A1 * | 4/2013 | ..... G07D 11/40 |

* cited by examiner

BANKNOTE PROCESSING APPARATUS

CROSS REFERENCE TO RELATED APPLICATIONS

This application is a Continuation Application under 35 U.S.C. § 120 of U.S. patent application Ser. No. 15/921,717, filed on Mar. 15, 2018, which claims the benefit under 35 U.S.C. § 119 of a Japanese Patent Application No. 2017-049794 filed on Mar. 15, 2017, the entire disclosures of which are incorporated herein by reference in its entirety.

TECHNICAL FIELD

The present invention relates to a banknote processing apparatus.

BACKGROUND ART

PTL 1 discloses a winding-type storage module that receives a banknote in the short-edge orientation and winds up and stores the banknote. PTL 1 also discloses a stacking-type storage module that receives each banknote in the short-edge orientation and stacks and stores the banknotes.

CITATION LIST

Patent Literature

PTL 1
Japanese Patent No. 6042950

SUMMARY OF INVENTION

Technical Problem

In recent years, for example, banknotes each including a strip-like member of, e.g., a polymer material or a metal wire have appeared. Such banknotes have the characteristic of being less bendable in either the short-edge orientation or the long-edge orientation depending on the position at which the strip-like member is to be attached.

Thus, a winding-type storage module that receives a banknote in the short-edge orientation and stores the banknote may fail to properly store the banknote depending on the orientation in which the banknote is less bendable.

Also, friction coefficients between a paper material and a roller may differ from those between a strip-like member and the roller, and thus, a feeding speed of the roller may be different in a part including the strip-like member from a part not including the strip-like member, and result in oblique passage of the banknote.

Thus, a stacking-type storage module that receives a banknote in the short-edge orientation and stores the banknote may fail to properly feed the banknote depending on the position of the strip-like member in the banknote.

Therefore, an object of the present invention is to provide a technique that enables a banknote to be properly stored and fed out.

Solution to Problem

A banknote processing apparatus includes: a transport unit that transports a banknote; a long-edge orientation storage unit that receives and stores, in a first orientation, the banknote transported by the transport unit, the first orientation being an orientation in which a short edge of the banknote is a leading edge thereof; a short-edge orientation storage unit that receives and stores, in a second orientation, the banknote transported by the transport unit, the second orientation being an orientation in which a long edge of the banknote is the leading edge thereof; and a control unit that selects, by controlling the transport unit, a storage destination for the banknote transported by the transport unit, from among any of the long-edge orientation storage unit and the short-edge orientation storage unit.

Advantageous Effects of Invention

The present invention enables a banknote to be properly stored and fed out.

DESCRIPTION OF EMBODIMENTS

Embodiments of the present invention will be described below with reference to the accompanying drawings.

Embodiment 1

Figure 1:
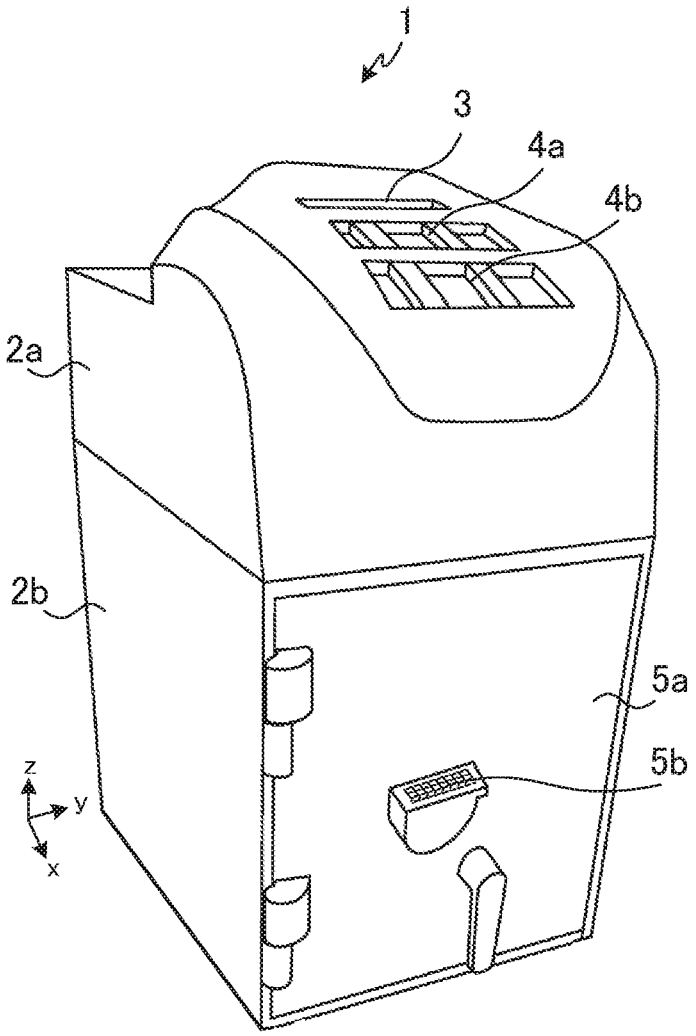
FIG. 1 is a perspective view of a banknote processing apparatus according to Embodiment 1.

FIG. 1 is a perspective view of a banknote processing apparatus 1 according to Embodiment 1. The banknote processing apparatus 1 illustrated in FIG. 1 is used, for example, in a field in which a great deal of cash is handled, such as a bank or a supermarket. For example, the banknote processing apparatus 1 is used for cash depositing and dispensing, counting and storage management, etc. in teller service at a bank counter or handling of sales proceeds in a supermarket, etc. In the below, the x, y, z-axis orthogonal coordinate system illustrated in FIG. 1 is set for the banknote processing apparatus 1. Also, regarding a transported position of a rectangular banknote when the banknote is transported on a transport path, is stored in a storage unit or is fed from the storage unit, the banknote being transported with a short edge of the banknote as a leading edge thereof is referred to as the banknote being transported "in a long-edge orientation" and the banknote being transported with a long edge of the banknote as the leading edge thereof is referred to as the banknote being transported "in a short-edge orientation". Also, the transported position of the banknote transported in the long-edge orientation is referred to as "long edge position", and the transported position of the banknote transported in the short-edge orientation is referred to as "short-edge position".

As illustrated in FIG. 1, the banknote processing apparatus 1 is divided in an upper unit 2*a* and a lower unit 2*b*.

The upper unit 2*a* includes an inlet 3 and outlets 4*a*, 4*b*. The inlet 3 is an inlet for depositing a banknote into the banknote processing apparatus 1. The outlets 4*a*, 4*b* are outlets for removing a banknote dispensed from the banknote processing apparatus 1. Also, the outlets 4*a*, 4*b* are outlets for removing a rejected banknote or an unrecognizable banknote, etc.

The lower unit 2*b* includes an open/close door 5*a* and an electronic lock 5*b*. The open/close door 5*a* is a door for access to the inside of the lower unit 2*b*. Upon the open/close door 5*a* being opened, storage units that store banknotes, which are housed in the lower unit 2*b*, can be accessed (see the long-edge orientation storage module 16 and the short-edge orientation storage units 17*a* to 17*h* in FIG. 2). At a front surface of the open/close door 5*a*, the electronic lock 5*b* is provided, and the open/close door 5*a* can be opened by an input of a preset pass-cord to the electronic lock 5*b*.

Figure 2:
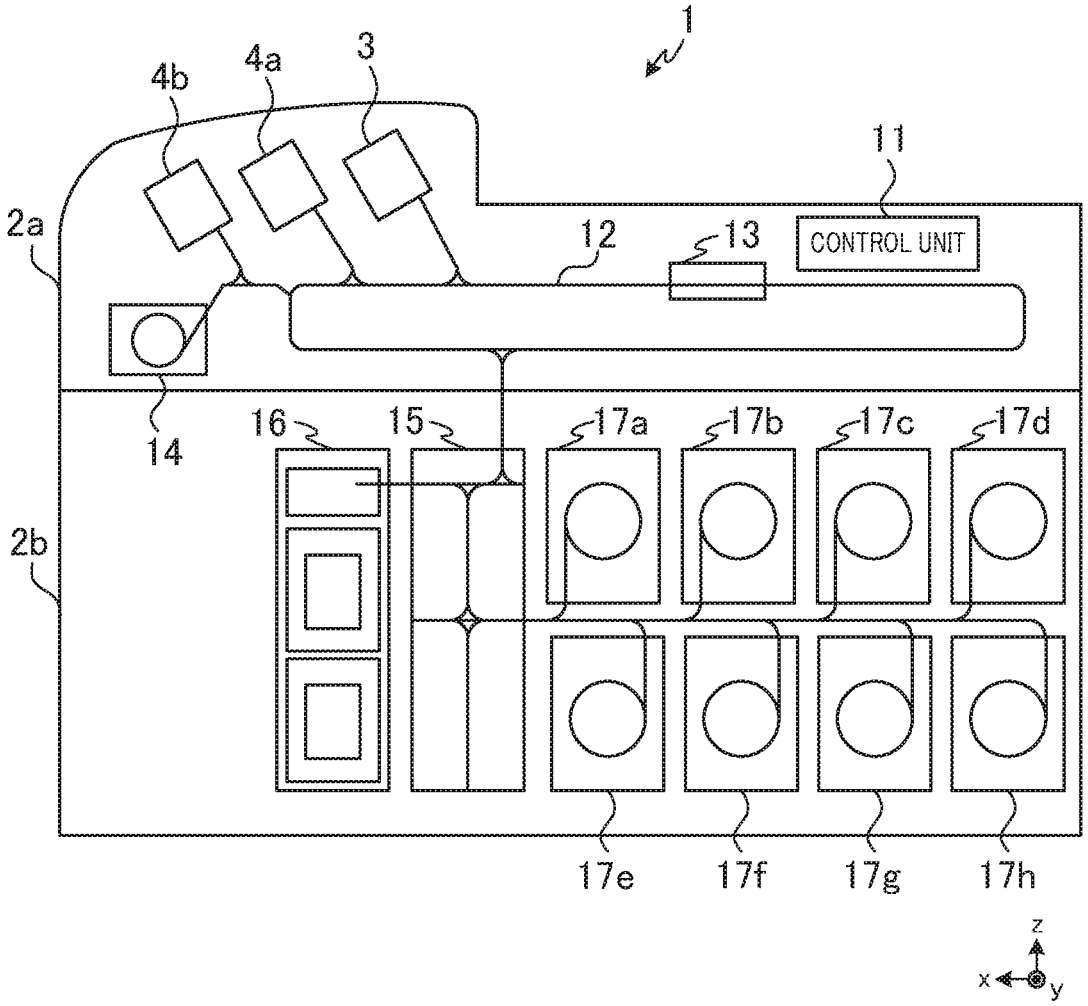
FIG. 2 is a schematic cross-sectional view of the banknote processing apparatus in FIG. 1 as viewed from the +y-axis side.

FIG. 2 is a schematic cross-sectional view of the banknote processing apparatus 1 in FIG. 1 as viewed from the +y-axis side. In FIG. 2, the same components as those in FIG. 1 are provided with the same reference numerals as those in FIG. 1. In FIG. 2, the banknote processing apparatus 1 in FIG. 1 is illustrated in a manner simplified in shape, etc.

As illustrated in FIG. 2, the upper unit 2*a* of the banknote processing apparatus 1 includes a control unit 11, a transport unit 12, a recognition unit 13 and an escrow unit 14. The lower unit 2*b* includes a transport module 15, the long-edge orientation storage module 16 and the short-edge orientation storage units 17*a* to 17*h*.

The control unit 11 controls the entire banknote processing apparatus 1. For example, the control unit 11 performs depositing processing for a banknote deposited from the inlet 3. Specifically, the control unit 11 controls the transport unit 12 to transport the banknote deposited from the inlet 3, to the recognition unit 13. The control unit 11 controls the recognition unit 13 to cause the recognition unit 13 to recognize authenticity, a state of damage, a state of tearing, a transported position or a denomination, etc. of the banknote. The state of damage includes a state of a banknote being faded (stained) as a result of being worn out and a state of a banknote being soiled by an ink, etc. The state of tearing includes a state of a banknote having a hole, a state of a banknote being partially missing and a state of a banknote being partially torn out. The transported position includes a short-edge position and a long-edge position and also may include four, face, back, top and bottom, positions of a banknote. The control unit 11 temporarily retains, e.g., a normal banknote in the escrow unit 14 and transports, e.g., a rejected banknote or an unrecognizable banknote to the outlets 4*a*, 4*b*, based on a result of the recognition by the recognition unit 13. Then, the control unit 11 transports the banknote temporarily retained in the escrow unit 14 to any of the long-edge orientation storage module 16 and the short-edge orientation storage units 17*a* to 17*h*.

Also, the control unit 11 performs, for example, dispensing processing for banknotes stored in the long-edge orientation storage module 16 and the short-edge orientation storage units 17*a* to 17*h*. Specifically, the control unit 11 feeds banknotes according to a dispensing request from a user, from the long-edge orientation storage module 16 and the short-edge orientation storage units 17*a* to 17*h*. The control unit 11 controls the transport module 15 and the transport unit 12 to transport the fed banknotes to the outlets 4*a*, 4*b*. The aforementioned functions of the control unit 11 are provided by, for example, an apparatus including a CPU (Central Processing Unit) and, e.g., a memory that stores programs and predetermined data.

The transport unit 12 includes a looped transport path. The transport unit 12 is connected to the inlet 3, the outlets 4*a*, 4*b*, the escrow unit 14 and the transport module 15. The transport unit 12 transports a banknote in a short-edge orientation.

The recognition unit 13 is provided on the transport unit 12. The recognition unit 13 includes an image sensor, an infrared sensor, an ultraviolet sensor or a magnetic sensor, etc. and recognizes authenticity, a state of damage, a state of tearing, a transported position or a denomination, etc. of the banknote transported by the transport unit 12.

The escrow unit 14 temporarily retains, for example, a banknote deposited from the inlet 3. Also, the escrow unit 14 temporarily retains, for example, a rejected banknote, etc. resulting from dispensing processing. The escrow unit 14 is, for example, a winding-type storage unit including a drum that allows a banknote to be wound up thereon.

The transport module 15 includes a transport path connecting the transport unit 12, the long-edge orientation storage module 16 and the short-edge orientation storage units 17*a* to 17*h*, which will be described below (for example, in FIG. 3). The transport module 15 transports a banknote in the short-edge orientation. The transport module 15 is demountably mounted in the lower unit 2*b*.

The long-edge orientation storage module 16 is a winding-type storage unit including a drum that allows a banknote to be wound up thereon. The long-edge orientation storage module 16 includes a long-edge orientation storage unit and receives a banknote transported from the transport module 15 in the long-edge orientation and stores the banknote, which will be described later (for example, FIGS. 4 and 5). The long-edge orientation storage module 16 is demountably mounted in the lower unit 2*b*.

Each of the short-edge orientation storage units 17*a* to 17*h* is a winding-type storage unit including a drum that allows a banknote to be wound up thereon. Each of the short-edge orientation storage units 17*a* to 17*h* receives a banknote transported from the transport module 15 in the short-edge orientation and stores the banknote, which will be described below(for example, FIG. 6). The short-edge orientation storage units 17*a* to 17*h* are demountably mounted in the lower unit 2*b*.

Figure 3:
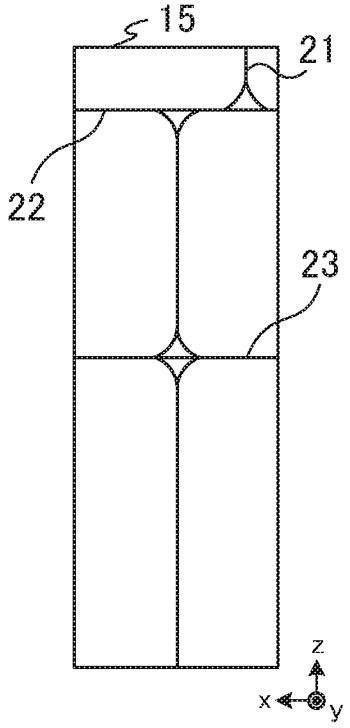
FIG. 3 is a schematic cross-sectional view of a transport module as viewed from the +y-axis side.

FIG. 3 is a schematic cross-sectional view of the transport module 15 as viewed from the +y-axis side. As illustrated in FIG. 3, the transport module 15 includes transport units (transport paths) 21 to 23.

Upon the transport module 15 being mounted in the lower unit 2*b*, the transport unit 21 is connected to a transport unit connected to the transport unit 12. The transport unit 22 is connected to a transport unit connected to the long-edge orientation storage module 16. The transport unit 23 is connected to a transport unit connected to the short-edge orientation storage units 17*a* to 17*h*.

The transport module 15 includes a plurality of diverter units for selecting a transport route for a banknote. The transport module 15 selects a transport destination for a banknote according to control of the diverter units by the control unit 11.

For example, the transport module 15 transports a banknote transported from the transport unit 12, to the transport unit 22 to transport the banknote to the long-edge orientation storage module 16, or transports a banknote transported from the transport unit 12, to the transport unit 23 to transport the banknote to the short-edge orientation storage units 17*a* to 17*h*. Also, the transport module 15 transports a banknote transported from the long-edge orientation storage module 16, to the transport unit 21 to transport the banknote to the transport unit 12, or transports a banknote transported from the short-edge orientation storage units 17*a* to 17*h*, to the transport unit 21 to transport the transport unit 12.

The transport module 15 can be replaced with the short-edge orientation storage units 17*a* to 17*h* illustrated in FIG. 2. For example, the transport module 15 can be mounted at the position of the short-edge orientation storage units 17*b*, 17*f* illustrated in FIG. 2. Also, the short-edge orientation storage units 17*b*, 17*f* illustrated in FIG. 2 are mounted at the position of the transport module 15. In other words, in the banknote processing apparatus 1, the demoutable transport module 15 enables flexibly configuring transport paths.

Figure 4:
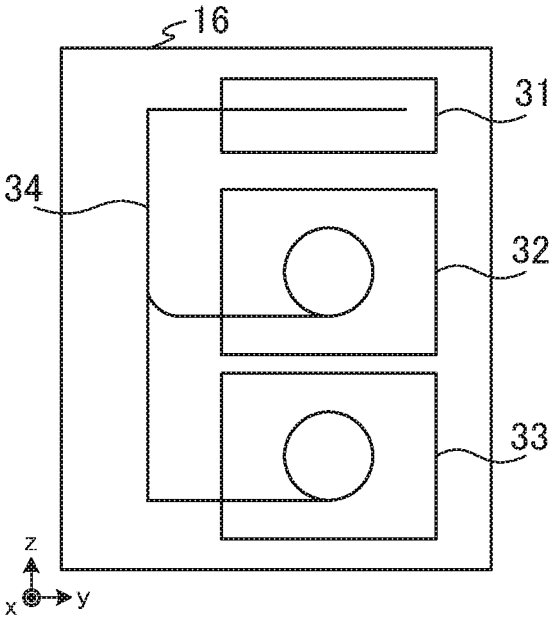
FIG. 4 is a schematic cross-sectional view of a long-edge orientation storage module as viewed from the +x-axis side.

FIG. 4 is a schematic cross-sectional view of the long-edge orientation storage module 16 as viewed from the +x-axis side. As illustrated in FIG. 4, the long-edge orientation storage module 16 includes a shifting unit 31, long-edge orientation storage units 32, 33 and a transport unit 34.

The shifting unit 31 is disposed upstream, in the transport direction, of the long-edge orientation storage units 32, 33, and a banknote is transported from the transport module 15 to the shifting unit 31. The banknote is transported in a short-edge orientation from the back side toward the front side of the sheet of FIG. 4 (toward the +x-axis side), to the shifting unit 31.

The shifting unit 31 shifts a transported position of the banknote transported from the transport module 15 so as to match an orientation in which the long-edge orientation storage units 32, 33 receive a banknote, and feeds the banknote to the transport unit 34, which will be described below (for example, FIG. 5). The banknote fed to the transport unit 34 is transported to either of the long-edge orientation storage units 32, 33 according to control of the diverter units by the control unit 11.

The long-edge orientation storage units 32, 33 store the banknote transported by the transport unit 34. Also, the long-edge orientation storage units 32, 33 feed a stored banknote to the transport unit 34. The banknote fed to the transport unit 34 is transported to the shifting unit 31. The shifting unit 31 shifts a transported position of the transported banknote and feeds the banknote to the transport module 15.

Here, in FIG. 4, the long-edge orientation storage module 16 includes two long-edge orientation storage units 32, 33; however, the present invention is not limited to this case. The long-edge orientation storage module may include one or three or more long-edge orientation storage units.

Figure 5:
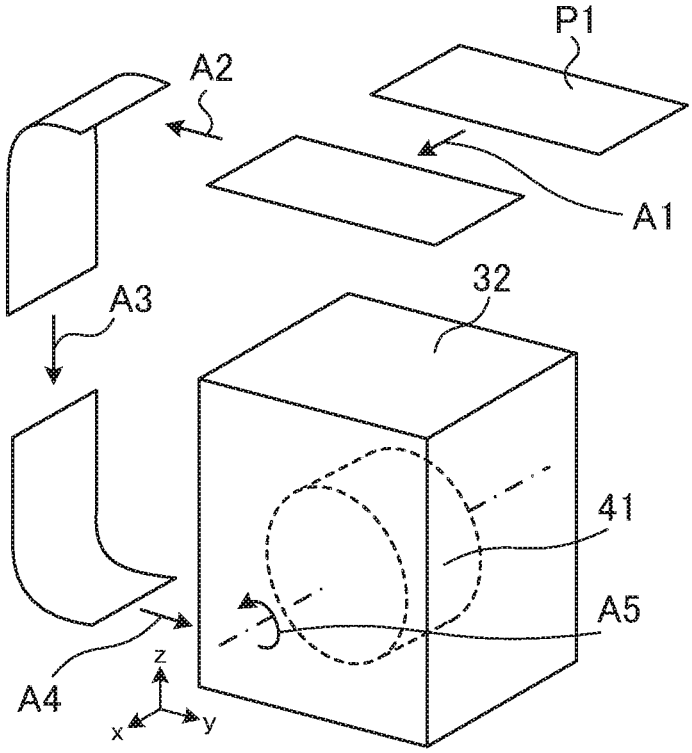
FIG. 5 is a diagram illustrating an example of storing of a banknote in a long-edge orientation storage unit.

FIG. 5 is a diagram illustrating an example of storing of a banknote in the long-edge orientation storage unit 32. In FIG. 5, the long-edge orientation storage unit 32 illustrated in FIG. 4 is illustrated. Also, in FIG. 5, a banknote P1 to be stored in the long-edge orientation storage unit 32 is illustrated. As illustrated in FIG. 5, the long-edge orientation storage unit 32 includes a drum 41.

As described above, the transport unit 12 and the transport module 15 transport a banknote in a short-edge orientation. Therefore, the banknote is transported with a long edge of the banknote as a leading edge thereof to the shifting unit 31 illustrated in FIG. 4.

For example, arrow A1 illustrated in FIG. 5 indicates a transport direction of the banknote P1 transported from the transport module 15 to the shifting unit 31 (not illustrated in FIG. 5). As indicated by arrow A1, the banknote P1 is transported with the long edge of the banknote as the leading edge thereof toward the +x-axis side. In other words, the banknote P1 is transported in the short-edge orientation.

The transport direction of the banknote P1 is shifted by the shifting unit 31 illustrated in FIG. 4, whereby a transported position of the banknote P1 is shifted. For example, as indicated by arrow A2 in FIG. 5, the banknote P1 is transported toward the −y-axis side so that a short edge of the banknote becomes the leading edge thereof. In other words, the shifting unit 31 shifts the transport direction of the banknote P1 by 90 degrees from the +x-axis direction to the −y-axis direction to shift the transported position of the banknote P1 from a short-edge position to a long-edge position.

The banknote P1 whose transport direction has been shifted is transported to the long-edge orientation storage unit 32 by the transport unit 34 illustrated in FIG. 4. For example, as indicated by arrow A3 in FIG. 5, the banknote P1 is transported to the long-edge orientation storage unit 32.

The long-edge orientation storage unit 32 includes an opening portion for storing the banknote P1 in a side surface as viewed from the −y-axis side. The long-edge orientation storage unit 32 receives the banknote P1 transported by the transport unit 34 in an orientation in which the short edge of the banknote is the leading edge thereof (long-edge orientation), from the opening portion provided in the side surface.

For example, as indicated by arrow A4, the long-edge orientation storage unit 32 receives the banknote P1 in the long-edge orientation. Then, the long-edge orientation storage unit 32 winds up the banknote P1 received in the long-edge orientation, on the drum 41 to store the banknote P1.

As indicated by the alternate long and short dash line in FIG. 5, a rotation axis of the drum 41 extends in the x-axis direction. When the drum 41 receives the banknote P1, the drum 41 rotates in the arrow A5 direction in FIG. 5.

A flow of an operation for feeding the banknote P1 stored in the long-edge orientation storage unit 32 is opposite to the above-described flow. For example, the drum 41 rotates in a direction that is opposite to the arrow A5 direction in FIG. 5. The long-edge orientation storage unit 32 feeds the banknote P1 in the long-edge orientation to the transport unit 34, by means of the rotation of the drum 41 in the opposite direction.

The banknote P1 fed to the transport unit 34 is transported with a short edge of the banknote as the leading edge thereof to the shifting unit 31. The shifting unit 31 shifts the transport direction of the banknote P1 transported from the transport unit 34 so that a long edge of the banknote becomes the leading edge thereof and feeds the banknote P1 to the transport module 15.

Here, as with the long-edge orientation storage unit 32, the long-edge orientation storage unit 33 receives a banknote transported by the transport unit 34, from an opening portion for storing a banknote, in an orientation in which a short edge of the banknote is a leading edge thereof and stores the banknote. Also, the long-edge orientation storage unit 33 feeds the banknote in the orientation in which a short edge of the banknote is the leading edge thereof.

Figure 6:
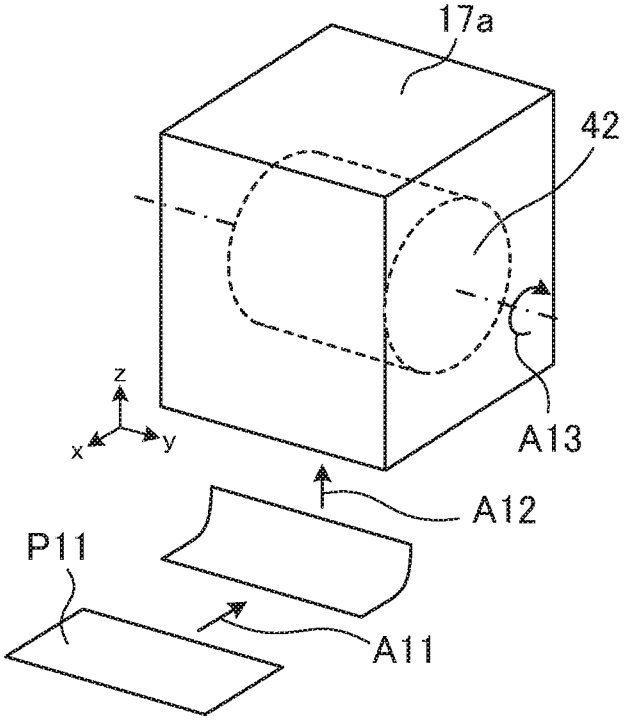
FIG. 6 is a diagram illustrating an example of storing of a banknote in a short-edge orientation storage unit.

FIG. 6 is a diagram illustrating an example of storing of a banknote in the short-edge orientation storage unit 17*a*. In FIG. 6, the short-edge orientation storage unit 17*a* illustrated in FIG. 2 is illustrated. Also, in FIG. 6, a banknote P11 to be stored in the short-edge orientation storage unit 17*a* is illustrated. As illustrated in FIG. 6, the short-edge orientation storage unit 17*a* includes a drum 42.

As described above, the transport unit 12 and the transport module 15 transport a banknote in the short-edge orientation. Therefore, the banknote is transported with a long edge of the banknote as a leading edge thereof to the short-edge orientation storage unit 17*a* illustrated in FIG. 6.

For example, arrow A11 illustrated in FIG. 6 indicates a transport direction of the banknote P11 when the banknote P11 is transported from the transport module 15 to the short-edge orientation storage unit 17*a*. As indicated by arrow A11, the banknote P11 is transported with a long edge of the banknote as a leading edge thereof, toward the −x-axis side. In other words, the banknote P11 is transported in a short-edge orientation.

The short-edge orientation storage unit 17*a* includes an opening portion for storing the banknote P11, in a bottom surface thereof. The short-edge orientation storage unit 17*a* receives the banknote P11 transported from the transport module 15, in an orientation in which the long edge of the banknote is the leading edge thereof (short-edge orientation), from the opening portion provided in the bottom surface.

For example, as indicated by arrow A12, the short-edge orientation storage unit 17*a* receives the banknote P11 in the short-edge orientation. Then, the short-edge orientation storage unit 17*a* winds up the banknote P11 received in the short-edge orientation, on the drum 42 to store the banknote P11.

As indicated by the alternate long and short dash line in FIG. 6, a rotation axis of the drum 42 extends in the y-axis direction. In other words, the rotation axis of the drum 42 extends in a direction that is different from that of the rotation axis of the drum 41 in the long-edge orientation storage unit 32. Specifically, the rotation axis of the drum 42 and the rotation axis of the drum 41 in the long-edge orientation storage unit 32 form an angle of 90 degrees. When the drum 42 receives the banknote P11, the drum 42 rotates in the arrow A13 direction in FIG. 6.

A flow of an operation for feeding the banknote P11 stored in the short-edge orientation storage unit 17*a* is opposite to the above-described flow. For example, the drum 42 rotates in a direction opposite to the arrow A13 direction in FIG. 6. The short-edge orientation storage unit 17*a* feeds the banknote P11 in the short-edge orientation by means of rotation of the drum 42 in the opposite direction. The banknote P11 fed from the short-edge orientation storage unit 17*a* is transported to the transport module 15.

Here, as with the short-edge orientation storage unit 17*a*, the short-edge orientation storage units 17*b* to 17*h* each receive a banknote in a short-edge orientation and store the banknote. Also, the short-edge orientation storage units 17*b* to 17*h* each feed a banknote in a short-edge orientation.

Figure 7:
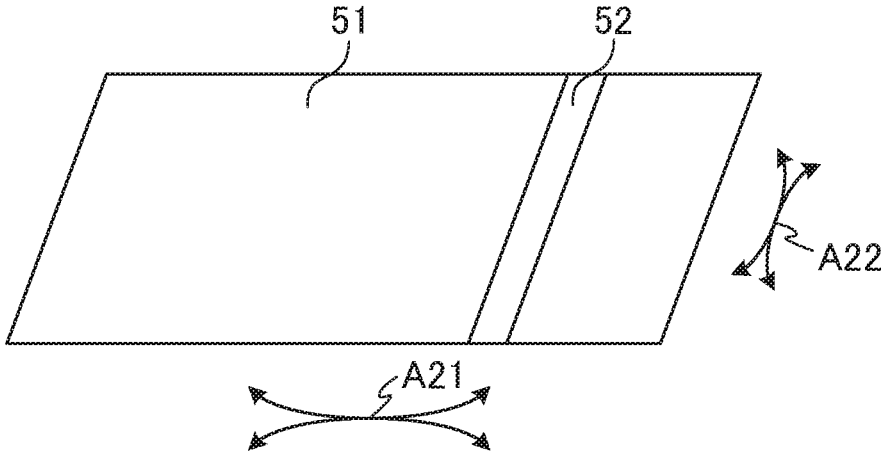
FIG. 7 is a diagram illustrating an example of a banknote to be subjected to depositing processing or dispensing processing in a banknote processing apparatus.

FIG. 7 is a diagram illustrating an example of a banknote to be subjected to depositing processing or dispensing processing in the banknote processing apparatus 1. In FIG. 7, a banknote 51 is illustrated. As illustrated in FIG. 7, the banknote 51 includes a strip-like other member 52 that is parallel to short edges of the banknote. The other member 52 includes, for example, a thread including a metal as a material or a polymer.

Where the banknote 51 includes the other member 52, there may be a direction in which the banknote is less bendable. For example, as illustrated in FIG. 7, if the other member 52 is provided in parallel to the short edges of the banknote, the banknote 51 may be bendable in the arrow A21 direction but less bendable in the arrow A22 direction in FIG. 7.

As described above, if the banknote 51 that is less bendable in the arrow A22 direction is stored in the short-edge orientation storage unit 17*a* illustrated in FIG. 6, a state of winding on the drum 42 may deteriorate. For example, the banknote 51 may fail to bend along a circumference of the drum 42 and partly float from the drum 42. If the state of winding on the drum 42 is poor, a jam may occur when a banknote is stored or fed, or a banknote storage capacity may decrease.

Therefore, the control unit 11 selects a storage destination for a banknote from among the long-edge orientation storage units 32, 33 and the short-edge orientation storage units 17*a* to 17*h* based on a type of the banknote to be recognized by the recognition unit 13. For example, in the case of the banknote 51 including the other member 52 that is parallel to the short edges of the banknote, the control unit 11 stores the banknote 51 in either of the long-edge orientation storage units 32, 33. If the banknote 51 is stored in either of the long-edge orientation storage units 32, 33, the banknote 51 is bent in the arrow A21 direction in FIG. 7 and stored (see FIG. 5), enabling suppression of storage state deterioration.

On the other hand, for example, if the banknote 51 includes another member that is parallel to long edges of the banknote, the banknote 51 is less bendable in the arrow A21 direction in FIG. 7. In this case, the control unit 11 stores the banknote 51 in any of the short-edge orientation storage units 17*a* to 17*h*. If the banknote 51 is stored in any of the short-edge orientation storage units 17*a* to 17*h*, the banknote 51 is bent in the arrow A22 direction in FIG. 7 and stored (see FIG. 6), enabling suppression of storage state deterioration.

As described above, the long-edge orientation storage units 32, 33 each receive a banknote transported by the transport unit 12 and the transport module 15, in an orientation in which a short edge of the banknote is a leading edge thereof, and store the banknote. The short-edge orientation storage units 17*a* to 17*h* each receive a banknote transported by the transport unit 12 and the transport module 15, in an orientation in which a long edge of the banknote is a leading edge thereof and store the banknote. The control unit 11 controls the transport unit 12 and the transport module 15 so as to select a storage destination for a banknote transported by the transport unit 12 and the transport module 15, from among any of the long-edge orientation storage units 32, 33 and the short-edge orientation storage units 17*a* to 17*h*.

Consequently, the banknote processing apparatus 1 can properly store and feed a banknote. For example, the banknote processing apparatus 1 controls the transport unit 12 and the transport module 15 so as to store a banknote that is less bendable in the arrow A22 direction illustrated in FIG. 7, in either of the long-edge orientation storage units 32, 33. Also, the banknote processing apparatus 1 controls the transport unit 12 and the transport module 15 so as to store a banknote that is less bendable in the arrow A21 direction illustrated in FIG. 7, in any of the short-edge orientation storage units 17*a* to 17*h*. Consequently, the banknote processing apparatus 1 can properly store and feed a banknote.

Also, the banknote processing apparatus 1 provides an easy cassette interface with another banknote processing apparatus. For example, the short-edge orientation storage units 17*a* to 17*h* can be demounted, and then mounted in another banknote processing apparatus that processes a banknote in a short-edge orientation. Also, the long-edge orientation storage module 16 can be demounted, and then mounted in another banknote processing apparatus that processes a banknote in a long-edge orientation.

Here, although in the above, the shifting unit 31 is provided inside the long-edge orientation storage module 16, the shifting unit 31 may be provided outside the long-edge orientation storage module 16.

Also, the control unit 11 selects a storage destination for a transported banknote, based on a type of the banknote recognized by means of recognition processing performed by the recognition unit 13. The type of the banknote includes the one classified based on at least one of a denomination of the banknote, a size of the banknote, a position of a thread provided in the banknote, a material of the banknote, a state of damage of the banknote, a state of tearing of the banknote and a transported position of the banknote. For example, the control unit 11 stores a banknote including a strip-like other member provided in parallel to short edges of the banknote, in either of the long-edge orientation storage units 32, 33. Also, the control unit 11 stores a banknote including a strip-like other member provided in parallel to long edges of the banknote, in any of the short-edge orientation storage units 17*a* to 17*h*. Also, the control unit 11 stores a banknote whose long edges have a length that is larger than a predetermined length, in either of the long-edge orientation storage units 32, 33. Also, the control unit 11 stores a banknote whose short edges have a length that is smaller than a predetermined length, in either of the long-edge orientation storage units 32, 33. Also, the control unit 11 stores, for example, a banknote formed of a material that is less bendable in the arrow A22 direction in FIG. 7, in either of the long-edge orientation storage units 32, 33. Also, the control unit 11 stores, for example, a banknote formed of a material that is less bendable in the arrow A21 direction in FIG. 7, in any of the short-edge orientation storage units 17*a* to 17*h*.

The size of the banknote, the position of the thread provided in the banknote and the material of the banknote can be identified by the denomination of the banknote, and thus, the storage destination of the transported banknote may be selected based on the denomination of the banknote. Also, the control unit 11 stores, for example, a torn banknote including a tear that is parallel to short edges of the banknote, in either of the long-edge orientation storage units 32, 33. Each of the short-edge orientation storage units 17*a* to 17*h* winds up a banknote on the relevant drum via later-described tapes (see FIG. 16), and if a torn banknote including a tear that is parallel to short edges of the banknote is stored in any of the short-edge orientation storage units 17*a* to 17*h*, the tear cannot be held by the tapes, which may result in enlargement of the tear. On the other hand, if a torn banknote including a tear that is parallel to short edges of the banknote is stored in either of the long-edge orientation storage units 32, 33, the tear is held by tapes, enabling prevention of enlargement of the hear. As described above, whether a long-edge orientation or a short-edge orientation is advantageous for processing a banknote may also depend on the state of damage or tearing of a banknote including whether or not the banknote includes a tear. Also, the control unit 11 may select a storage destination for a transported banknote, for example, according to whether the banknote is transported in a face-up position or a face-down position. This is because depending on the material and/or the printing manner of the banknote, unbendability in the arrow A21 direction in FIG. 7 may differ between the front side and the back side of the banknote and unbendability in the arrow A22 direction in FIG. 7 may differ between the front side and the back side of the banknote.

Also, the type of the banknote may be the one classified based on bending rigidity when the short edges of the banknote are bent (bending rigidity in the direction indicated by arrow A22 in FIG. 7) or bending rigidity when the long edges of the banknote are bent (bending rigidity in the direction indicated by arrow A21 in FIG. 7). For example, the control unit 11 stores a banknote having large bending rigidity when short edges of the banknote are bent, in either of the long-edge orientation storage units 32, 33. The control unit 11 stores a banknote having large bending rigidity when long edges of the banknote are bent, in any of the short-edge orientation storage units 17*a* to 17*h*. Here, as a thickness of the banknote is larger, generally, the bending rigidity will be larger. Also, a banknote including a thread has large bending rigidity compared to a banknote including no thread. Also, a polymer has large bending rigidity compared to paper.

Also, although in the above, the transport unit 12 and the transport module 15 transport a banknote in a short-edge orientation, the transport unit 12 and the transport module 15 may transport a banknote in a long-edge orientation. In this case, a shifting unit that shifts a transport direction of a banknote is provided upstream of the short-edge orientation storage units 17*a* to 17*h* and shifts a transport direction of a banknote to a short-edge orientation. Consequently, the short-edge orientation storage units 17*a* to 17*h* can receive a banknote in an orientation in which a long edge of the banknote is a leading edge thereof and store the banknote.

Also, the banknote processing apparatus 1 can perform reconciliation processing. For example, the control unit 11 controls the transport module 15 and the transport unit 12 to transport a banknote stored in the long-edge orientation storage module 16 or the short-edge orientation storage units 17*a* to 17*h* to the recognition unit 13 and retain the banknote in the escrow unit 14. Then, the control unit 11 returns the banknote retained in the escrow unit 14 to the long-edge orientation storage module 16 or the short-edge orientation storage units 17*a* to 17*h*.

Also, the banknote processing apparatus 1 may include no transport module 15. In other words, the transport unit 12 may extend to and be connected to the long-edge orientation storage module 16 and the respective short-edge orientation storage units 17*a* to 17*h*.

Also, in the above, the banknote processing apparatus 1 includes one long-edge orientation storage module and eight short-edge orientation storage units; however, the present invention is not limited to this case. The number of long-edge orientation storage modules and the number of short-edge orientation storage units can be changed depending on the status of use as necessary. For example, if a denomination is allocated to each storage unit, for each denomination, whether the denomination is suitable for short-edge winding or long-edge winding is determined, and storage units of types suitable for the respective denominations are mounted in the lower unit 2*b*. Also, as described next, in the banknote processing apparatus 1, all the storage units may be configured by long-edge orientation storage modules.

Figure 8:
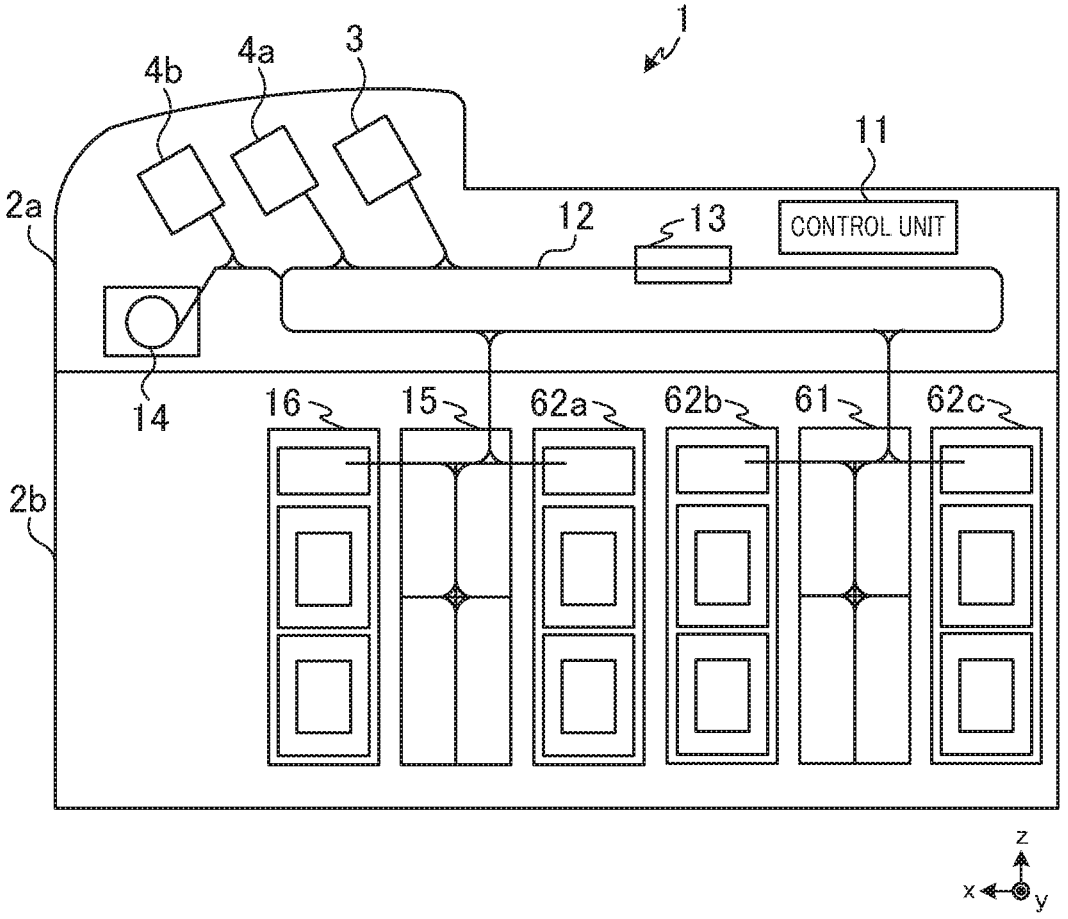
FIG. 8 is a schematic cross-sectional view of the banknote processing apparatus in FIG. 1 as viewed from the +y-axis side.

FIG. 8 is a schematic cross-sectional view of the banknote processing apparatus 1 in FIG. 1 as viewed from the +y-axis side. In FIG. 8, the same components as those in FIG. 2 are provided with the same reference numerals as those in FIG. 2.

As with a transport module 15, a transport module 61, which is illustrated in FIG. 8, includes a plurality of diverter units for selecting a transport route for a banknote. Here, the transport module 15 interconnects a transport unit 12 and a long-edge orientation storage module 16, and also interconnects the transport unit 12 and a long-edge orientation storage module 62*a*. The transport module 61 interconnects the transport unit 12 and a long-edge orientation storage module 62*b*, and also interconnects the transport unit 12 and a long-edge orientation storage module 62*c*.

The long-edge orientation storage modules 62*a* to 62*c* each have a configuration that is similar to that of the long-edge orientation storage module 16. For example, each of the long-edge orientation storage modules 62*a* to 62*c* includes a shifting unit 31, long-edge orientation storage units 32, 33 and a transport unit 34, which are illustrated in FIG. 4.

As described above, in the banknote processing apparatus 1, all storage units may be configured by the long-edge orientation storage modules 16 and 62*a* to 62*c*. As a matter of course, in the banknote processing apparatus 1, all the storage units may be configured by short-edge orientation storage units.

If all the storage units are configured by the long-edge orientation storage modules 16 and 62*a* to 62*c*, rotation axes of the respective drums all extend in the x-axis direction.

Embodiment 2

Embodiment 1 has been described in terms of winding-type storage units. Embodiment 2 will be described in terms of stacking-type storage units. The parts that are different from those of Embodiment 1 will be described below.

Figure 9:
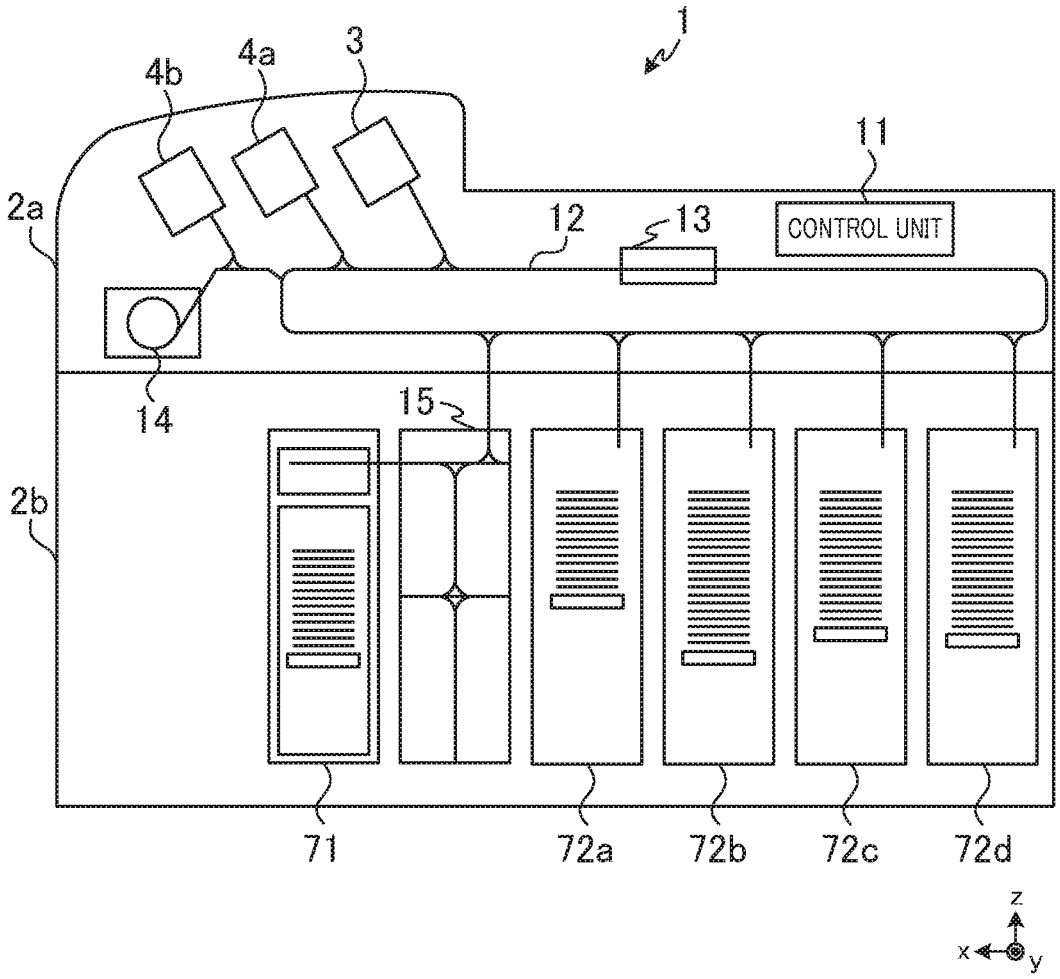
FIG. 9 is a schematic cross-sectional view of a banknote processing apparatus according to Embodiment 2 as viewed from the +y-axis side.

FIG. 9 is a schematic cross-sectional view of a banknote processing apparatus 1 according to Embodiment 2 as viewed from the +y-axis side. In FIG. 9, the same components as those in FIG. 2 are provided with the same reference numerals as those in FIG. 2.

As illustrated in FIG. 9, the banknote processing apparatus 1 includes a stacking-type long-edge orientation storage module 71 and stacking-type short-edge orientation storage units 72*a* to 72*d*. The long-edge orientation storage module 71 and the short-edge orientation storage units 72*a* to 72*d* each store banknotes in such a manner that the banknotes are stacked in a direction perpendicular to printed surfaces thereof.

Figure 10:
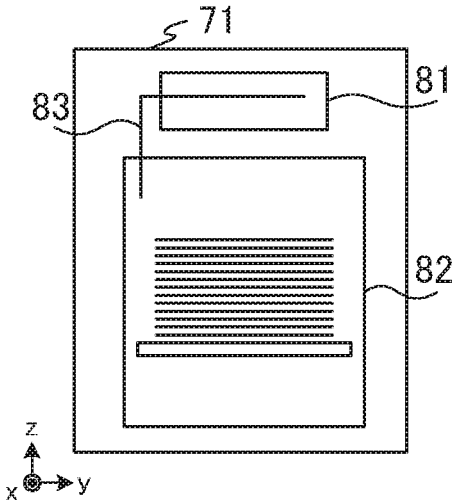
FIG. 10 is a schematic cross-sectional view of a long-edge orientation storage module as viewed from the +x-axis side.

FIG. 10 is a schematic cross-sectional view of the long-edge orientation storage module 71 as viewed from the +x-axis side. As illustrated in FIG. 10, the long-edge orientation storage module 71 includes a shifting unit 81, a long-edge orientation storage unit 82 and a transport unit 83.

The shifting unit 81 is disposed upstream, in a transport direction, of the long-edge orientation storage unit 82, and a banknote is transported from a transport module 15 to the shifting unit 81. The banknote is transported with a long edge of the banknote as a leading edge thereof from the back side toward the front side of the sheet of FIG. 10 (toward the +x-axis side), to the shifting unit 81.

The shifting unit 81 shifts a transported position of a banknote transported from the transport module 15 so as to match an orientation in which the long-edge orientation storage unit 82 receives a banknote, and feeds the banknote to the transport unit 83, which will be described below (for example, FIG. 11). The banknote fed to the transport unit 83 is transported to the long-edge orientation storage unit 82.

The long-edge orientation storage unit 82 stores the banknote transported by the transport unit 83. Also, the long-edge orientation storage unit 82 feeds a stored banknote to the transport unit 83. The banknote fed to the transport unit 83 is transported to the shifting unit 81. The shifting unit 81 shifts a transported position of the transported banknote and feeds the banknote to the transport module 15.

Figure 11:
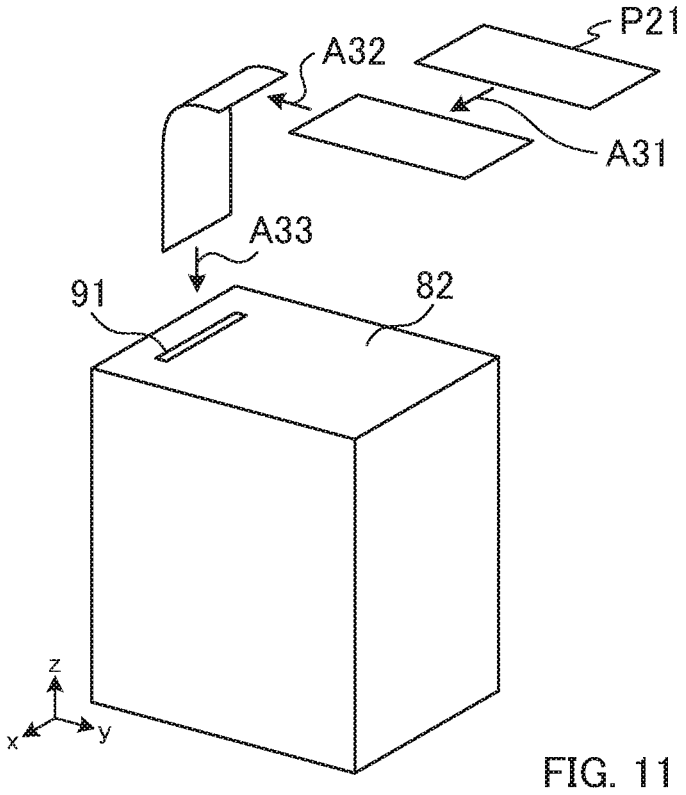
FIG. 11 is a diagram illustrating an example of storing of a banknote in a long-edge orientation storage unit.

FIG. 11 is a diagram illustrating an example of storing of a banknote in the long-edge orientation storage unit 82. In FIG. 11, the long-edge orientation storage unit 82 illustrated in FIG. 10 is illustrated. Also, in FIG. 11, a banknote P21 to be stored in the long-edge orientation storage unit 82 is illustrated. As illustrated in FIG. 11, the long-edge orientation storage unit 82 includes an opening portion 91 for receiving a banknote.

As described above, the transport unit 12 and the transport module 15 transport a banknote in a short-edge orientation. Therefore, the banknote is transported with a long edge of the banknote as a leading edge thereof to the shifting unit 81 illustrated in FIG. 10.

For example, arrow A31 illustrated in FIG. 11 indicates a transport direction of the banknote P21 when the banknote P21 is transported from the transport module 15 to the shifting unit 81 (not illustrated in FIG. 11). As indicated by arrow A31, the banknote P21 is transported with a long edge of the banknote as a leading edge thereof toward the +x-axis side. In other words, the banknote P21 is transported in a short-edge orientation.

The transport direction of the banknote P21 is shifted by the shifting unit 81 illustrated in FIG. 10, whereby a transported position of the banknote P21 is shifted. For example, as indicated by arrow A32 in FIG. 11, the banknote P21 is transported with a short edge of the banknote as the leading edge thereof toward the −y-axis side. In other words, the shifting unit 81 shifts the transport direction of the banknote P21 by 90 degrees from the +x-axis side to the −y-axis side to shift the transported position of the banknote P21.

The banknote P21 whose transport direction has been shifted is transported to the long-edge orientation storage unit 82 by the transport unit 83 illustrated in FIG. 10. For example, as indicated by arrow A33 in FIG. 11, the banknote P21 is transported to the long-edge orientation storage unit 82.

The long-edge orientation storage unit 82 receives the banknote P21 transported by the transport unit 83, in an orientation in which the short edge of the banknote is the leading edge thereof, from the opening portion 91 provided in an upper surface. For example, as indicated by arrow A33, the long-edge orientation storage unit 82 receives the banknote P21 in an orientation in which the short edge of the banknote is the leading edge thereof. Then, the long-edge orientation storage unit 82 stacks the banknote P21 received in the orientation in which the short edge of the banknote is the leading edge thereof, in a direction perpendicular to printed surfaces thereof (see, for example, banknotes stacked inside the long-edge orientation storage unit 82 in FIG. 10).

A flow of an operation for feeding the banknote P21 stored in the long-edge orientation storage unit 82 is opposite to the above-described flow. For example, the long-edge orientation storage unit 82 feeds the banknote P21 in an orientation in which a short edge of the banknote is the leading edge thereof, to the transport unit 83.

The banknote P21 fed to the transport unit 83 is transported with the short edge of the banknote as the leading edge thereof to the shifting unit 81. The shifting unit 81 shifts a transport direction of the banknote P21 transported from the transport unit 83 so that a long edge of the banknote becomes the leading edge thereof and feeds the banknote P21 to the transport module 15.

Figure 12:
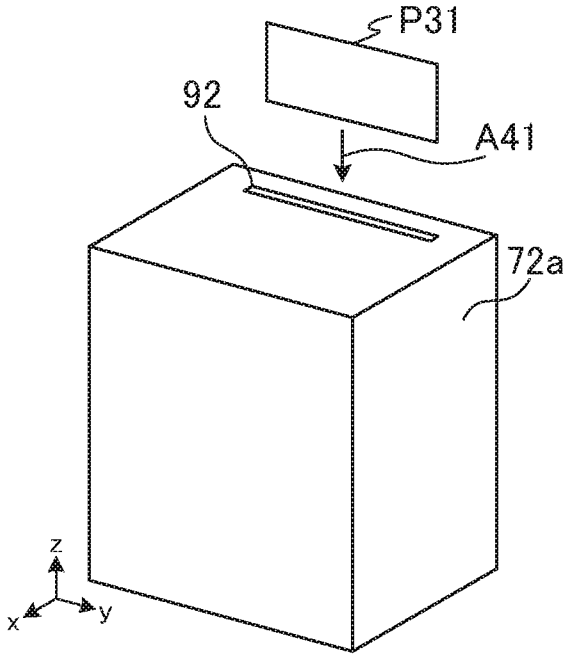
FIG. 12 is a diagram illustrating an example of storing of a banknote in a short-edge orientation storage unit.

FIG. 12 is a diagram illustrating an example of storing of a banknote in the short-edge orientation storage unit 72*a*. In FIG. 12, the short-edge orientation storage unit 72*a* illustrated in FIG. 9 is illustrated. Also, in FIG. 12, a banknote P31 to be stored in the short-edge orientation storage unit 72*a* is illustrated.

As described above, the transport unit 12 and the transport module 15 transport a banknote in a short-edge orientation. Therefore, the banknote is transported with a long edge of the banknote as a leading edge thereof, to the short-edge orientation storage unit 72*a* illustrated in FIG. 12.

For example, arrow A41 illustrated in FIG. 12 indicates a transport direction of the banknote P31 when the banknote P31 is transported from the transport unit 12 to the short-edge orientation storage unit 72*a*. As indicated by arrow A41, the banknote P31 is transported with the long edge of the banknote as the leading edge thereof toward the −x-axis side. In other words, the banknote P31 is transported in a short-edge orientation.

The short-edge orientation storage unit 72*a* includes an opening portion 92 for storing the banknote P31, in an upper surface thereof. The short-edge orientation storage unit 72*a* receives the banknote P31 transported from the transport unit 12 in an orientation in which the long edge of the banknote is the leading edge thereof, from the opening portion 92 provided in the upper surface. For example, as indicated by arrow A41, the short-edge orientation storage unit 72*a* receives the banknote P31 in the orientation in which the long edge of the banknote is the leading edge thereof. Then, the short-edge orientation storage unit 72*a* stacks the banknote P31 received in the orientation in which the long edge of the banknote is the leading edge thereof, in a direction perpendicular to printed surfaces thereof.

A flow of an operation for feeding the banknote P31 stored in the short-edge orientation storage unit 72*a* is opposite to the above-described flow. For example, the short-edge orientation storage unit 72*a* feeds the banknote P31 in an orientation in which a long edge of the banknote is the leading edge thereof. The banknote P31 fed from the short-edge orientation storage unit 72*a* is transported to the transport unit 12.

Here, as with the short-edge orientation storage unit 72*a*, the short-edge orientation storage units 72*b* to 72*d* also each receive a banknote in an orientation in which a long edge of the banknote is a leading edge thereof, and store the banknote. Also, the short-edge orientation storage units 72*b* to 72*d* each feed a banknote in an orientation in which a long edge of the banknote is a leading edge thereof.

As described above, the banknote processing apparatus 1 includes the stacking-type long-edge orientation storage unit 82 and the stacking-type short-edge orientation storage units 72*a* to 72*d*. The control unit 11 controls the transport unit 12 and the transport module 15 so as to select a storage destination for a banknote transported by the transport unit 12 and the transport module 15, from among any of the long-edge orientation storage unit 82 and the short-edge orientation storage units 72*a* to 72*d*. Consequently, the banknote processing apparatus 1 can properly store and feed a banknote.

Here, although the shifting unit 81 is provided inside the long-edge orientation storage module 71, the shifting unit 81 may be provided outside the long-edge orientation storage module 71.

For stacking-type storage units, also, the control unit 11 selects a storage destination for a banknote transported, based on a type of the banknote recognized by recognition processing performed by the recognition unit 13. The type of the banknote includes the one classified based on at least one of a denomination of the banknote, a size of the banknote, a position of a thread provided in the banknote, a material of the banknote, a state of damage of the banknote, a state of tearing of the banknote and a transported position of the banknote. For example, the control unit 11 stores a banknote including a strip-like other member provided in parallel to short edges of the banknote and having a thickness that is only increased at the strip-like other member, in any of the short-edge orientation storage units 72*a* to 72*d*. If such banknote is stored in the long-edge orientation storage unit 82, a front edge of the banknote to be stored may be caught by a strip-like other member of a banknote previously stored, which results in poor storage. Also, for example, the control unit 11 stores a banknote including a strip-like other member provided in parallel to short edges of the banknote, the strip-like other member having friction coefficients that are different from the rest part of the banknote, in the long-edge orientation storage unit 82. This is because: a stacking-type storage unit is configured to transport a banknote using a plurality of rollers simultaneously to store or feed a banknote; and if such banknote is stored in any of the short-edge orientation storage units 72*a* to 72*d*, only some of the plurality of rollers are brought into contact with the strip-like other member thereof, which may result in transport failure at the time of storing or feeding.

Also, in the above, the banknote processing apparatus 1 include a stacking-type long-edge orientation storage module and stacking-type short-edge orientation storage units; however, the present invention is not limited to this case. For example, the banknote processing apparatus 1 may include all of a stacking-type long-edge orientation storage module, a stacking-type short-edge orientation storage unit, a winding-type long-edge orientation storage module and a winding-type short-edge orientation storage unit, or a partial combination thereof.

Embodiment 3

In each of Embodiment 1 and Embodiment 2, a transported position of a banknote is shifted by shifting a transport direction of the banknote. For example, as illustrated in FIG. 5, a transport direction of a banknote transported in the +x-axis direction is shifted so as to transport the banknote in the −y-axis direction. In Embodiment 3, a transported position of a banknote is shifted by rotating the banknote without changing a transport direction of the banknote.

Figure 13:
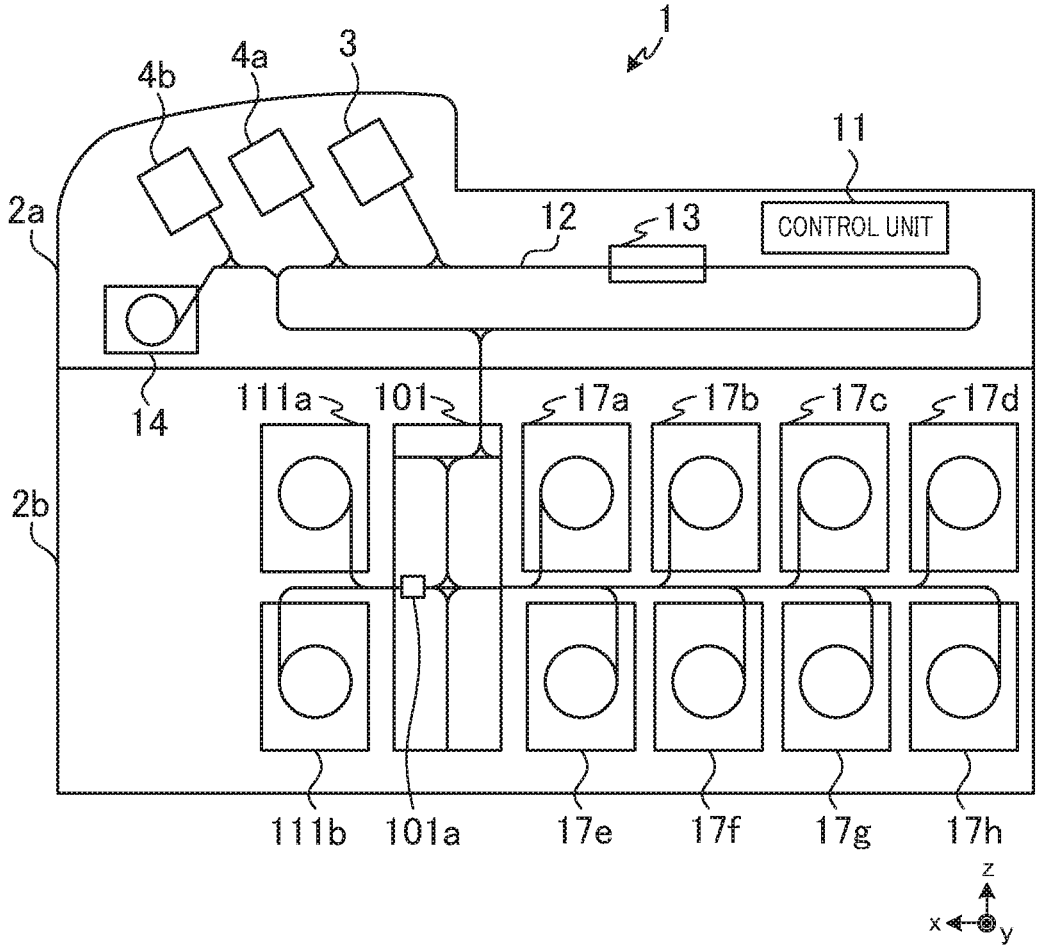
FIG. 13 is a schematic cross-sectional view of a banknote processing apparatus according to Embodiment 3 as viewed from the +y-axis side.

FIG. 13 is a schematic cross-sectional view of a banknote processing apparatus 1 according to Embodiment 3 as viewed from the +y-axis side. In FIG. 13, the same components as those in FIG. 2 are provided with the same reference numerals as those in FIG. 2. As illustrated in FIG. 13, the banknote processing apparatus 1 includes a transport module 101 and winding-type long-edge orientation storage units 111*a*, 111*b*.

As with the transport module 15, the transport module 101 illustrated in FIG. 13 includes a plurality of diverter units for selecting a transport route of a banknote. The transport module 101 interconnects a transport unit 12 and the long-edge orientation storage units 111*a*, 111*b* and also interconnects the transport unit 12 and short-edge orientation storage units 17*a* to 17*h*.

The transport module 101 includes a shifting unit 101*a*. The shifting unit 101*a* shifts a transported position of a banknote by rotating the banknote without changing a transport direction of the banknote, which will be described below (for example, FIG. 14).

The long-edge orientation storage units 111*a*, 111*b* each include a drum that allows a banknote to be wound up thereon. A rotation axis of each of the drums extends in the y-axis direction, which is the same as rotation axes of drums in the short-edge orientation storage units 17*a* to 17*h*.

Figure 14:
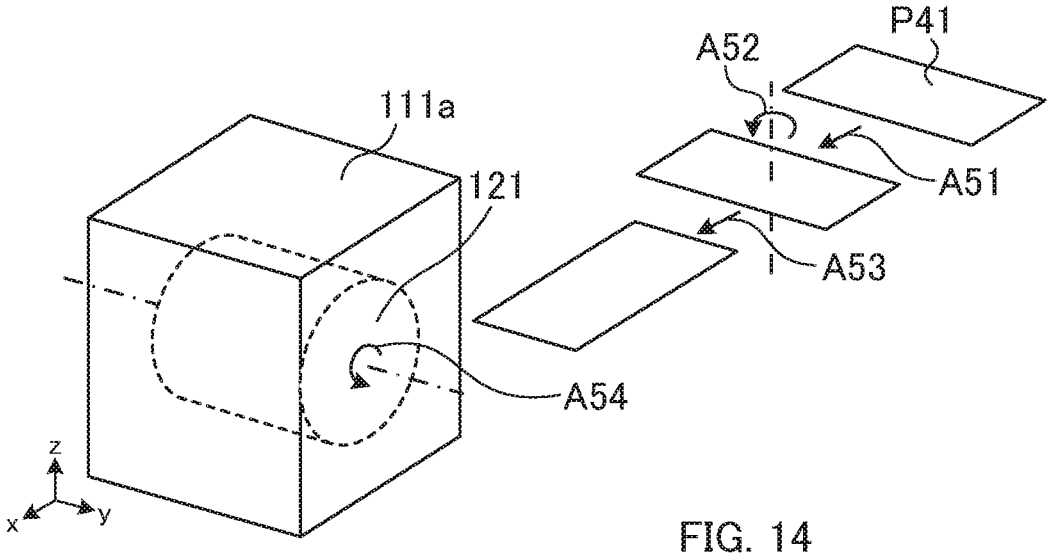
FIG. 14 is a diagram illustrating an example of storing of a banknote in a long-edge orientation storage unit.

FIG. 14 is a diagram illustrating an example of storing of a banknote in the long-edge orientation storage unit 111*a*. In FIG. 14, the long-edge orientation storage unit 111*a* illustrated in FIG. 13 is illustrated. Also, in FIG. 14, a banknote P41 to be stored in the long-edge orientation storage unit 111*a* is illustrated. As illustrated in FIG. 14, the long-edge orientation storage unit 111*a* includes a drum 121.

The transport unit 12 and the transport module 101 transport a banknote in a short-edge orientation. Therefore, a banknote is transported with a long edge of the banknote as a leading edge thereof, to the shifting unit 101*a*.

For example, arrow A51 illustrated in FIG. 14 indicates a transport direction of the banknote P41 when the banknote P41 is transported from the transport unit 12 to the shifting unit 101*a* (not illustrated in FIG. 14). As indicated by arrow A51, the banknote P41 is transported with a long edge of the banknote P41 as a leading edge thereof toward the +x-axis side. In other words, the banknote P41 is transported in the short-edge orientation.

A transported position of the banknote P41 is shifted by the shifting unit 101*a* illustrated in FIG. 13, with the transport direction left unchanged. For example, as indicated by arrow A52 in FIG. 14, the banknote P41 is rotated so that a short edge of the banknote becomes the leading edge thereof. In other words, the shifting unit 101*a* rotates the banknote P41 by 90 degrees around an axis perpendicular to printed surfaces of the banknote to shift the transported position.

The banknote P41 whose transported position has been shifted is transported to the long-edge orientation storage unit 111*a*, with the transport direction kept as the +x-axis direction. For example, as indicated by arrow A53 in FIG. 14, the banknote P41 is transported with the short edge of the banknote as the leading edge thereof to the long-edge orientation storage unit 111*a*.

The long-edge orientation storage unit 111*a* includes an opening portion for storing the banknote P41, in a bottom surface thereof. The long-edge orientation storage unit 111*a* receives the banknote P41 transported by the transport unit, in an orientation in which the short edge of the banknote is the leading edge thereof, from the opening portion provided in the bottom surface. Then, the long-edge orientation storage unit 111*a* winds up the banknote P41 received in the orientation in which the short edge of the banknote is the leading edge thereof on the drum 121 to store the banknote P41.

As indicated by the alternate long and short dash line in FIG. 14, a rotation axis of the drum 121 extends in the y-axis direction. When the banknote P41 is received, the drum 121 rotates in the arrow A54 direction in FIG. 14.

A flow of an operation for feeding the banknote P41 stored in the long-edge orientation storage unit 111*a* is opposite to the above-described flow. For example, the drum 121 rotates in a direction opposite to the arrow A54 direction in FIG. 14. The rotation of the drum 121 in the opposite direction causes the long-edge orientation storage unit 111*a* to feed the banknote P41 to the shifting unit 101*a* of the transport module 101 in an orientation in which a short edge of the banknote is the leading edge thereof.

The shifting unit 101*a* shifts (rotates) a position of the banknote P41 transported from the long-edge orientation storage unit 111*a* so that a long edge of the banknote becomes the leading edge thereof.

Here, as with the long-edge orientation storage unit 111*a*, the long-edge orientation storage unit 111*b* receives a banknote in a short-edge orientation. Also, the long-edge orientation storage unit 111*b* feeds a banknote in a short-edge orientation.

As described above, the shifting unit 101*a* of the banknote processing apparatus 1 shifts a transported position of a banknote by rotating the banknote around an axis perpendicular to printed surfaces of the banknote, without changing a transport direction of the banknote. Consequently, the banknote processing apparatus 1 can store banknotes in storage units suitable for the respective banknotes.

Here, in the above, the transport module 101 includes the shifting unit 101*a*; however, the present invention is not limited to this case. For example, the shifting unit 101*a* may be provided in a transport unit between the transport module 101 and the long-edge orientation storage units 111*a*, 111*b*.

Also, the above-described method is applicable to stacking-type storage units. For example, stacking-type storage units that receive a banknote transported by a transport unit in a short-edge orientation to store the banknote may be provided downstream, in a transport direction, of the transport module 101 in FIG. 13.

Embodiment 4

In Embodiment 4, some of storage units are housed in a secure space such as a safe.

Figure 15:
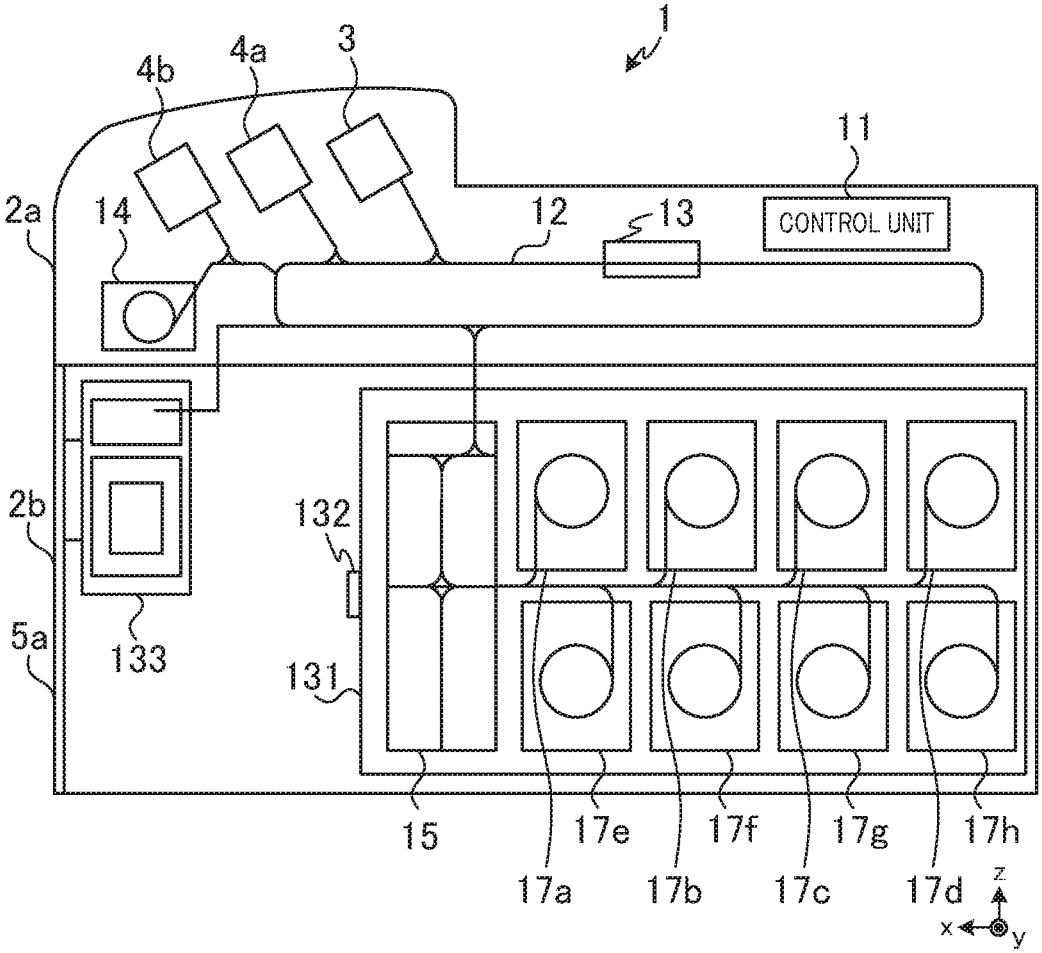
FIG. 15 is a schematic cross-sectional view of a banknote processing apparatus according to Embodiment 4 as viewed from the +y-axis side.

FIG. 15 is a schematic cross-sectional view of the banknote processing apparatus 1 according to Embodiment 4 as viewed from the +y-axis side. In FIG. 15, the same components as those in FIGS. 1 and 2 are provided with the same reference numerals as those in FIGS. 1 and 2. As illustrated in FIG. 15, the banknote processing apparatus 1 includes a safe 131, an electronic lock 132 and a long-edge orientation storage module 133.

The safe 131 is provided in a lower unit 2*b*. The safe 131 houses a transport module 15 and short-edge orientation storage units 17*a* to 17*h*. An electronic lock 132 for opening an open/close door provided at a front surface is provided at the safe 131.

At one surface (for example, a front surface) of the lower unit 2*b*, an open/close door 5*a* is provided. A long-edge orientation storage module 133 is provided on a back surface of the open/close door 5*a* of the lower unit 2*b*. The long-edge orientation storage module 133 is a winding-type storage unit and has a configuration that is similar to that of the long-edge orientation storage module 16 illustrated in FIG. 4. The long-edge orientation storage module 133 is demountably mounted on the back surface of the open/close door 5*a*. The long-edge orientation storage module 133 is used for addition or collection of banknotes. The long-edge orientation storage module 133 is connected to a transport path extending from the upper unit 2*a*. This transport path can be a transport path diverted from a transport unit 12 of an upper unit 2*a*. The control unit 11 selects a storage destination for a banknote transported, from among any of the long-edge orientation storage module 133 and the short-edge orientation storage units 17*a* to 17*h* inside the safe 131, based on a type of the banknote recognized by recognition processing performed by the recognition unit 13. The control for the storage destination selection is the same as those in Embodiments 1 to 4.

Authority to access the short-edge orientation storage units 17*a* to 17*h* inside the safe 131 is different from authority to access the long-edge orientation storage module 133 provided in the space between the safe 131 and the open/close door 5*a* (referred to as "normal space"). Since the long-edge orientation storage module 133 is provided in the normal space outside the safe 131, banknotes can easily be added to or collected from the long-edge orientation storage module 133 without accessing the inside of the safe 131.

As described above, the long-edge orientation storage module 133 is provided in the normal space outside the secure space. Consequently, banknotes can easily be added or collected.

Here, in the above, the long-edge orientation storage module 133 is of a winding type, but may be of a stacking type. Also, a short-edge orientation storage unit may be provided at the open/close door 5*a*. Also, either of a short-edge orientation storage unit and a long-edge orientation may selectively be provided at the open/close door 5*a*. Also, a long-edge orientation storage module may be housed inside the safe 131. Also, the open/close door 5*a* of the lower unit 2*b* is not necessarily needed and the long-edge orientation storage module 133 may be exposed outside depending on administrative restrictions. In this case, the long-edge orientation storage module 133 is attached to a bottom surface of the upper unit 2*a* or an attachment unit provided separately. Also, the long-edge orientation storage module 133 may be provided at a rear surface of the banknote processing apparatus 1 (right side in FIG. 15).

Embodiment 5

In Embodiment 5, a tape structure of a winding-type storage unit will be described.

Figure 16:
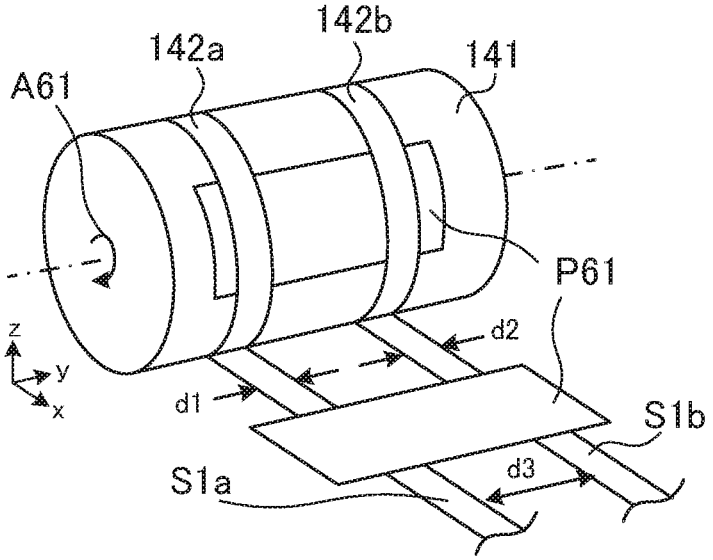
FIG. 16 is a schematic perspective view of a winding-type storage unit according to Embodiment 5.

FIG. 16 is a schematic perspective view of a winding-type storage unit according to Embodiment 5. In FIG. 16, a drum 141 and tapes 142*a*, 142*b* of a winding-type storage unit are illustrated. Also, in FIG. 16, a banknote P61 is illustrated. The x, y, z-axis orthogonal coordinate system illustrated in FIG. 16 is set for the winding-type storage unit below.

Tapes 142*a*, 142*b* are wound up by rotation of the drum 141. For example, upon rotation of the drum 141 in the arrow A61 direction in FIG. 16, the tapes 142*a*, 142*b* are wound up on the drum 141.

The banknote P61 is disposed between an outer circumferential surface of the drum 141 and surfaces S1*a*, S1*b* of the tapes 142*a*, 142*b*, the surfaces facing the drum 141. Consequently, upon rotation of the drum 141 in the direction indicated by arrow A61, the banknote P61 is wound up on the drum 141.

When the banknote P61 wound up on the drum 141 is fed, the drum 141 is rotated in a direction opposite to the direction indicated by arrow A61. Then, the tapes 142*a*, 142*b* wound up on the drum 141 are fed from the drum 141, and the banknote P61 wound up between the tapes 142*a*, 142*b* and the drum 141 is also fed.

Figure 17:
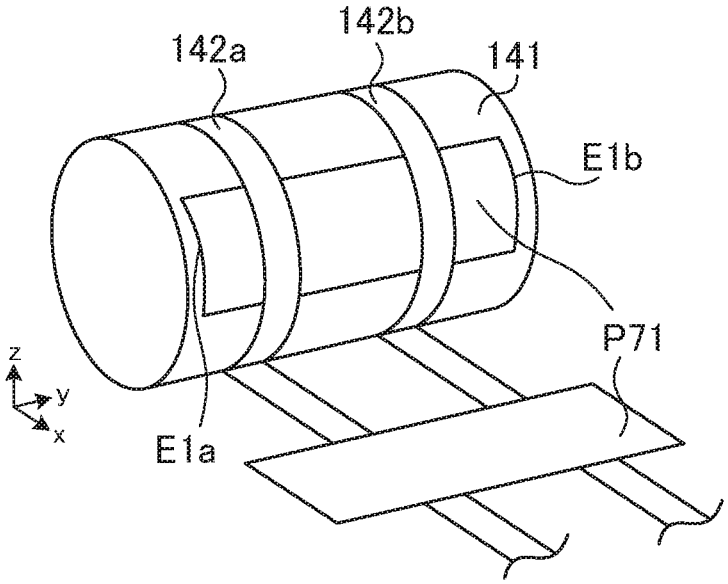
FIG. 17 is a schematic perspective view of a winding-type storage unit.

FIG. 17 is a schematic perspective view of a winding-type storage unit. In FIG. 17, the same components as those in FIG. 16 are provided with the same reference numerals as those in FIG. 16. In FIG. 17, a banknote P71 that is longer in a long-edge direction than the banknote P61 illustrated in FIG. 16 is illustrated.

As illustrated in the banknote P71, opposite ends E1*a*, E1*b* of the banknote P71 are positioned off from tapes 142*a*, 142*b* because of the long length in the long-edge direction. In this case, the opposite ends E1*a*, E1*b* of the banknote P71 are less bound by the tapes 142*a*, 142*b* and are likely to curl up. In this case, a storage rate of the winding-type storage unit is lowered, and a jam is likely to occur.

Figure 18:
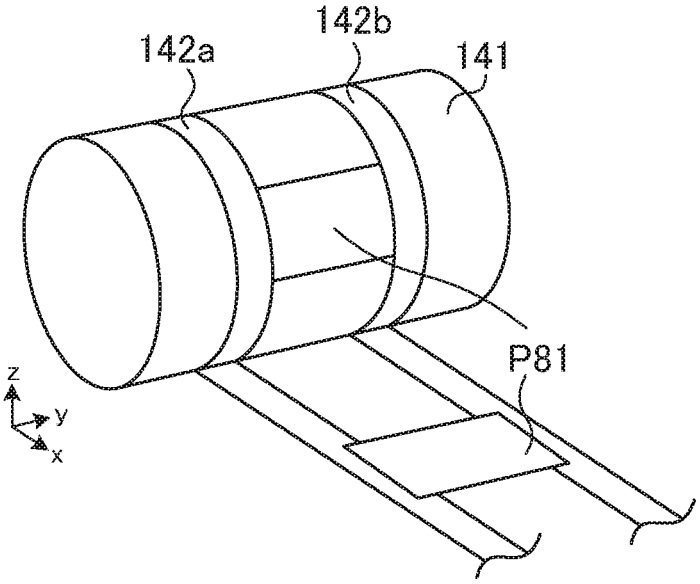
FIG. 18 is a schematic perspective view of a winding-type storage unit.

FIG. 18 is a schematic perspective view of a winding-type storage unit. In FIG. 18, the same components as those in FIG. 16 are provided with the same reference numerals as those in FIG. 16. In FIG. 18, a banknote P81 that is shorter in a long-edge direction than the banknote P61 illustrated in FIG. 16 is illustrated.

As illustrated in the banknote P81, the short length in the long-edge direction may cause, for example, one of the opposite ends of the banknote P81 to fail to be placed on a relevant tape 142*a* or 142*b* because of, e.g., displacement during transport. In this case, the banknote P81 is not wound up on the drum 141, resulting in occurrence of a jam.

Therefore, widths of and/or an interspace between tapes 142*a*, 142*b* are changed based on a size of a banknote to be stored in a winding-type storage unit.

For example, tape widths d1, d2, which are illustrated in FIG. 16, are changed based on a size of a banknote to be stored in a winding-type storage unit. Also, a tape interspace d3 is changed based on the size of the banknote to be stored in the winding-type storage unit.

Specifically, if the banknote to be stored is small, the tape widths d1, d2 are increased and/or the tape interspace d3 is reduced. Also, if the banknote is large, the tape widths d1, d2 are increased and/or the tape the interspace d3 is enlarged. Also, if the banknote is large, the number of tapes may be increased.

As described above, a banknote processing apparatus includes plural types of winding-type storage units. A part or all of the plurality of winding-type storage units have tape structures that differ depending on a size of a banknote to be stored. Consequently, the banknote processing apparatus can stably store banknotes.

Here, the tape structures may be changed based on a material of a banknote. For example, where a banknote that is less bendable because of a material thereof such as a polymer banknote is to be stored, tapes 142*a*, 142*b* of a material having large tension are used. Also, where a banknote that is less bendable because of a material thereof is to be stored, the number of tapes is increased and/or the tape widths d1, d2 are increased.

Also, a tape structure involves widths of a plurality of tapes, the number of the tapes, an interspace between the tapes and a material of the tapes. Each of the plural types of winding-type storage units may be different only in the widths of the plurality of tapes, the number of the tapes, the interspace between the tapes or the material of the tapes. Also, each of the plurality of winding-type storage units may be different in any combination of the widths of the plurality of tapes, the number of the tapes, the interspace between the tapes and the material of the tapes.

Also, the above-described winding-type storage units having different tape structures are applicable to the winding-type long-edge orientation storage units and winding-type short-edge orientation storage units described above.

Also, the plurality of winding-type storage units may be different in drive mechanism and/or control for driving the drum and/or the tapes. For example, where a banknote that is less bendable because of a material thereof such as a polymer banknote is to be stored, a drive mechanism that increases tension of the tapes may be provided or drive control may be changed.

(Supplement)

A banknote processing apparatus comprising a plurality of winding-type storage units each including a drum and tapes, wherein a part or all of the plurality of winding-type storage units are different in at least one of a width of the tapes, the number of tapes, an interspace between the tapes and a material of the tapes or control for driving the drum and/or the tapes, based on a type of a banknote to be stored, the type including a size or a material of the banknote.

REFERENCE SIGNS LIST

1 banknote processing apparatus
2*a* upper unit
2*b* lower unit
3 inlet
4*a*, 4*b* outlets
11 control unit
12 transport unit
13 recognition unit
14 escrow unit
15 transport module
16 long-edge orientation storage module
17*a* to 17*h* short-edge orientation storage unit
31 shifting unit
32, 33 long-edge orientation storage unit
34 transport unit

The invention claimed is:

1. A banknote processing apparatus, comprising:

a transport unit that transports a banknote;

a shifting unit that is disposed on the transport unit and shifts a transported position of the banknote;

a first banknote storage unit that receives a first banknote from the transport unit in a first transported position and feeds the first banknote to the transport unit in the first transported position;

a second banknote storage unit that feeds a second banknote in a second transported position; and a control unit that controls the transport unit to transport the second banknote in the second transported position, the second banknote being fed from the second banknote storage unit, and controls the shifting unit to shift the second transported position of the second banknote to the first transported position and transport the second banknote to the first banknote storage unit in the first transported position, wherein:

the first banknote storage unit is demountably provided outside a safe of the banknote processing apparatus, and the second banknote storage unit is provided inside the safe.

2. The banknote processing apparatus according to claim 1, wherein:

the first banknote storage unit is provided in the banknote processing apparatus in a state of being exposed outside the banknote processing apparatus.

3. The banknote processing apparatus according to claim 1, wherein:

the first banknote storage unit is provided at a rear surface of the banknote processing apparatus, the rear surface being on a side opposite to a side where an inlet for depositing banknote is provided.

4. The banknote processing apparatus according to claim 1, wherein:

authority to access the first banknote storage unit is different from authority to access the second banknote storage unit.

5. The banknote processing apparatus according to claim 1, wherein:

the first banknote storage unit stores a banknote to be added to the banknote processing apparatus.

6. The banknote processing apparatus according to claim 1, wherein:

the second banknote storage unit receives the second banknote in the second transported position, the control unit controls the transport unit to transport the first banknote in the first transported position, the first banknote being fed from the first banknote storage unit, and controls the shifting unit to shift the transported position of the first banknote transported in the first transported position to the second transported position, and transport the first banknote in the second transported position to the second banknote storage unit.

7. The banknote processing apparatus according to claim 1, wherein:

the first banknote storage unit stores a banknote collected from the banknote processing apparatus.

8. A banknote processing apparatus according to claim 1, wherein:

the control unit that controls the transport unit to transport the first banknote in the first transported position, the first banknote being fed from the first banknote storage unit, and controls the shifting unit to shift the first transported position of the first banknote to the second transported position.

9. A banknote processing apparatus, comprising:

a transport unit that transports a banknote;

a shifting unit that is disposed on the transport unit and shifts a transported position of the banknote;

a first banknote storage unit that receives a first banknote from the transport unit in a first transported position and feeds the first banknote to the transport unit in the first transported position; and a control unit that controls the shifting unit to shift a second transported position of a second banknote to the first transported position and transport the second banknote to the first banknote storage unit in the first transported position, wherein:

each of the first banknote and the second banknote has a short edge and a long edge that is longer than the short edge, the first transported position is a transported position in which either one of the short edge or the long edge is a leading edge, the second transported position is a transported position in which the other one of the short edge or the long edge is the leading edge, and the shifting unit rotates the second banknote by 90 degrees around an axis perpendicular to a printed surface of the banknote without changing a transport direction of the second banknote.

10. A banknote processing apparatus, comprising:

a transport unit that transports a banknote;

a shifting unit that is disposed on the transport unit and shifts a transported position of the banknote;

a first banknote storage unit that receives the banknote from the transport unit in a first transported position of the banknote and feeds the banknote to the transport unit in the first transported position;

a second banknote storage unit that receives a second banknote in a second transported position; and a control unit that controls the transport unit to transport the first banknote in the first transported position, the first banknote being fed from the first banknote storage unit, controls the shifting unit to shift the first transported position of the first banknote to a second transported position, and controls the transport unit to transport the first banknote in the second transported position to the second banknote storage unit, wherein:

the first banknote storage unit is demountably provided outside a safe of the banknote processing apparatus, and the second banknote storage unit is provided inside the safe.

11. The banknote processing apparatus according to claim 10, wherein:

the first banknote storage unit is provided in the banknote processing apparatus in a state of being exposed outside the banknote processing apparatus.

12. The banknote processing apparatus according to claim 10, wherein:

the first banknote storage unit is provided at a rear surface of the banknote processing apparatus, the rear surface being on a side opposite to a side where an inlet for depositing banknote is provided.

13. The banknote processing apparatus according to claim 10, wherein:

authority to access the first banknote storage unit is different from authority to access the second banknote storage unit.

14. A banknote processing apparatus according to claim 10, wherein:

the control unit that controls the shifting unit to shift the second transported position of the second banknote to the first transported position and controls the transport unit to transport the second banknote in the first transported position to the first banknote storage unit.

15. A banknote processing apparatus, comprising:

a transport unit that transports a banknote;

a shifting unit that is disposed on the transport unit and shifts a transported position of the banknote;

a first banknote storage unit that receives the banknote from the transport unit in a first transported position of the banknote and feeds the banknote to the transport unit in the first transported position; and a control unit that controls the transport unit to transport the banknote in the first transported position, the banknote being fed from the first banknote storage unit, and controls the shifting unit to shift the first transported position of the banknote to a second transported position, wherein:

the banknote has a short edge and a long edge that is longer than the short edge, the first transported position is a transported position in which either one of the short edge or the long edge is a leading edge, the second transported position is a transported position in which the other one of the short edge or the long edge is the leading edge, and, the shifting unit rotates the banknote by 90 degrees around an axis perpendicular to a printed surface of the banknote without changing a transport direction of the banknote.

16. A banknote processing method, comprising:

shifting a transported position, to a first transport position, of a banknote transported in a second transported position; and receiving the banknote in the first transported position, and transporting the banknote in the first transported position to a banknote storage unit that feeds the banknote in the first transported position, wherein:

the banknote has a short edge and a long edge that is longer than the short edge, the first transported position is a transported position in which either one of the short edge or the long edge is a leading edge, the second transported position is a transported position in which the other one of the short edge or the long edge is the leading edge, and, the shifting rotates the banknote by 90 degrees around an axis perpendicular to a printed surface of the banknote without changing a transport direction of the banknote.

* * * * *